US007036819B2

(12) United States Patent
Cooke et al.

(10) Patent No.: US 7,036,819 B2
(45) Date of Patent: May 2, 2006

(54) THREE-WAY RING PUZZLE

(76) Inventors: Douglas E. Cooke, 460 Main Street, Black's Harbour, New Brunswick (CA) E5H 1B8; Louise H. Cooke, 460 Main Street, Black's Harbour, New Brunswick (CA) E5H 1B8; Gerald Cooke, 601 Route 785, Utopia, New Brunswick (CA) E5C 2K6

( * ) Notice: Subject to any disclaimer, the term of this patent is extended or adjusted under 35 U.S.C. 154(b) by 0 days.

(21) Appl. No.: 10/967,257

(22) Filed: Oct. 19, 2004

(65) Prior Publication Data

US 2005/0093234 A1 May 5, 2005

Related U.S. Application Data

(60) Provisional application No. 60/516,293, filed on Nov. 3, 2003.

(51) Int. Cl.
*A63F 9/08* (2006.01)

(52) U.S. Cl. ..... 273/158

(58) Field of Classification Search ..... 273/156, 273/158; D21/482

See application file for complete search history.

(56) References Cited

U.S. PATENT DOCUMENTS

| | | | | |
|---|---|---|---|---|
| 895,710 | A * | 8/1908 | Allen | 273/156 |
| D54,759 | S * | 3/1920 | Marr | D21/482 |
| 1,356,610 | A | 10/1920 | Dudash | |
| 2,998,253 | A | 8/1961 | Kranzusch | |
| 3,698,719 | A | 10/1972 | Winslow | |
| 3,881,732 | A | 5/1975 | Winslow | |
| 4,000,901 | A | 1/1977 | Flores | |
| D246,922 | S | 1/1978 | Heign | |
| D246,924 | S | 1/1978 | Heign | |
| 4,391,445 | A | 7/1983 | Vizelyi | |
| 4,907,805 | A | 3/1990 | Watkins et al. | |
| D416,950 | S * | 11/1999 | Reynolds, Jr. | D21/482 |

FOREIGN PATENT DOCUMENTS

| | | |
|---|---|---|
| CA | 444591 | 10/1947 |
| CA | 1083623 | 8/1980 |

* cited by examiner

*Primary Examiner*—Steven Wong
(74) *Attorney, Agent, or Firm*—Mario Theriault

(57) ABSTRACT

In a first aspect of the invention, the three-way ring puzzle has a rectangular housing with a first and second opposite sides. A first series of stems extends from the first side, and a second series of stems extends from the second side. Each stem has an eyelet on its extremity outside the housing and a wire loop is loosely mounted in this eyelet. Each of the stems in the first series aligns with and is joined inside the housing to one of the stems in the second series. A first and second elongated wire bands are respectively mounted in the wire loops on the first and the second series of stems. In another aspect of the present invention, the housing has a cylindrical shape, the stems extend diametrically through the housing and each of the elongated wire bands has a curved shape.

20 Claims, 3 Drawing Sheets

THREE-WAY RING PUZZLE

FIELD OF THE INVENTION

This invention pertains to wire ring puzzles, and more particularly, it pertains to a ring puzzle that incorporates three games in one, and which can be played by one player, or by two players at the same time.

BACKGROUND OF THE INVENTION

Wire ring puzzle games are known to improve concentration, memory, imagination, ingenuity, determination and coordination of the user, in addition to provide great amusement. Although ring puzzle games belong to an old art, it is believed that there is a renewed interest in these games to develop logic and cleverness in children, and to improve dexterity and mental skills of persons recovering from accidents or illnesses. It is also believed that these ring puzzle games can be used by medical personnel to diagnose various affections and physical conditions, such as finger joint stiffness.

The wire ring puzzles that are of interest herein have not changed much during the last generation. These puzzles comprise a series of wire stems mounted along a straight line in a base. An eyelet is formed on the end of each stem, and a wire ring is mounted in that eyelet. Each ring, except the first one in the series encloses an adjacent stem, such that adjacent rings partly overlap each other. An elongated wire band is mounted through all the rings and encloses all the stems. The game consists of removing the wire band from the rings and the stems by doing a series of specific operations, and inserting the wire band back through the rings and around the stems to complete the game. This game has a moderate level of difficulty, as it can be solved by a majority of people. Moreover, the puzzle is portable and can be turned around to be played with either hand.

The ring puzzle game as known from the prior art is basically a solitary game where the player challenges himself/herself to complete the game without help from others. The common ring puzzle game is played by manipulating the wire band with the right hand if the user is right-handed, or with the left hand if the user is left-handed. In other words, there is no provision or stimulus in the prior art games to practice one hand more than the other.

Examples of the ring puzzles of the prior art are as follows;

CA Patent 444,591 issued to G. H. Smith on Oct. 21, 1947;

CA Patent 1,083,623 issued to C. Touchette on Aug. 12, 1980;

U.S. Pat. No. 2,998,253 issued to E. A. Kranzusch on Aug. 29, 1961;

U.S. Pat. No. 3,698,719 issued to L. M. Winslow on Oct. 17, 1972;

U.S. Pat. No. 3,881,732 issued to L. M. Winslow on May 6, 1975;

U.S. Pat. No. 4,000,901 issued to R. Flores on Jan. 4, 1977;

U.S. Pat. No. 4,907,805 issued to D. W. Watkins et al. on Mar. 13, 1990.

Although the prior art ring puzzles and games deserve undeniable merits, it is believed that a need still exists for a new game incorporating different levels of difficulty therein. Also, it is believed that a need still exists to make this game playable by two players at the same time, such as a mother and a child playing together for example. Further, it is believed that there is a need to incorporate in this game a level of difficulty which consists of manipulating the wire band with one's awkward hand.

SUMMARY OF THE INVENTION

In the ring puzzle according to the present invention, however, there are incorporated therein various degrees of difficulty to challenge a larger population group. The ring puzzle has two sides that can be played separately or simultaneously by one player. The two sides can also be played by two opponents, and one of the difficulties incorporated in the puzzle of the present invention consists of playing one side of the puzzle with one's awkward hand.

In accordance with one aspect of the present invention, there is provided a three-way ring puzzle, comprising a hollow housing having a first and second opposite sides. A first series of stems extends from the first side, and a second series of stems extends from the second side. Each stem has an eyelet on its extremity outside the housing, and a wire loop is loosely mounted in that eyelet. Each of the stems in the first series aligns with, and is joined inside the housing to one of the stems in the other series. There are also provided, a first and second elongated wire bands respectively mounted in the wire loops on the first and the second series of stems.

As mentioned, this ring puzzle can be played by one player, one side at the time or both sides simultaneously. It can also be played by two players competing against each other. Because of the two solitary games plus the social game, the puzzle according to the present invention is referred to herein as a three-way ring puzzle.

One degree of difficulty in the game consists of playing with diamond-shaped wire loops on one of the series of stems, and with circular rings on the other series of stems. Because the manipulation of the diamond-shaped wire loops is different from the manipulation of the circular rings, the solution of the diamond-shaped wire loop side of the puzzle requires more skills than the ring side.

In another aspect of the present invention, the first series of stems comprises a first stem and the second series of stems comprises a leading stem. The first stem in the first series of stems is aligned with the leading stem in the second series of stems such that both sides of the puzzle are played in a same direction. When two opponents play the game at the same time, one of the players manipulates one of the wire bands with his/her right hand, while the other player manipulates the other wire band with his/her left hand.

The housing can be rotated end-to-end to reverse the orientation in which the game is played. When the shapes of the wire loops are different on both series of stems, the puzzle can be tilted upside down to change degree of difficulty for each player without changing the hand with which the game is played. It will be appreciated that the housing can be rotated end-to-end and tilted upside down to change both the degree of difficulty and the hand of each player.

The three-way ring puzzle according to the present invention is preferably manufactured with two series of six stems in a first model for sale to the general public. A smaller version having only two series of four stems is believed to be more appropriate for use by preschool children. In this second model, the wire loops have flower-like shapes and different colours. This second model is believed to be advantageous for teaching colours to young children. It is also advantageous for teaching, the right side from the left side, the difference between over and under, and the importance of a sequence in problem solving. A third model of puzzle having series of three stems is believed to be useful in the medical field to diagnose a patient. For example, a medical professional reading game instructions to a patient manipulating the puzzle can easily monitor finger movement, as well as visual and audition skills or other conditions of that patient.

In accordance with another aspect of the present invention, there is provided a three-way ring puzzle, comprising a hollow cylindrical housing and a series of stems extending diametrically through this housing. The stems have a same length. Each stem has a first and second extremities outside the housing and an eyelet on each of these extremities. A first series of rings is mounted in the eyelets on the first extremities. A second series of rings is mounted in the eyelets on the second extremities. A first curved wire band is mounted through the rings in the first series of rings and encloses the stems near the first extremities of these stems. A second curved wire band is mounted through the rings in the second series of rings and encloses the stems near the second extremities of these stems.

The cylindrical shape of this housing constitutes an additional level of difficulty because the movement of the hand to remove one of the wire bands from the rings is circular as opposed to the linear movement in the prior art puzzles. Furthermore, it is believed that the novelty of the shape of this embodiment of the present invention and its appearance constitutes a level of difficulty and an appealing attribute challenging even those who have mastered the longitudinal puzzles of the prior art.

Still another feature of the three-way ring puzzle according to the present invention is that it is susceptible of a low cost of manufacture with regard to both materials and labour, and which accordingly is then susceptible of low prices of sale to the consumer, thereby making such three-way ring puzzle economically available to the public.

This brief summary has been provided so that the nature of the invention may be understood quickly. A more complete understanding of the invention can be obtained by reference to the following detailed description of the preferred embodiments thereof in connection with the attached drawings.

BRIEF DESCRIPTION OF THE DRAWINGS

Two embodiments of the present invention are illustrated in the accompanying drawings, in which like numerals denote like parts throughout the several views, and in which.

DESCRIPTION OF THE PREFERRED EMBODIMENTS

Figure 1:
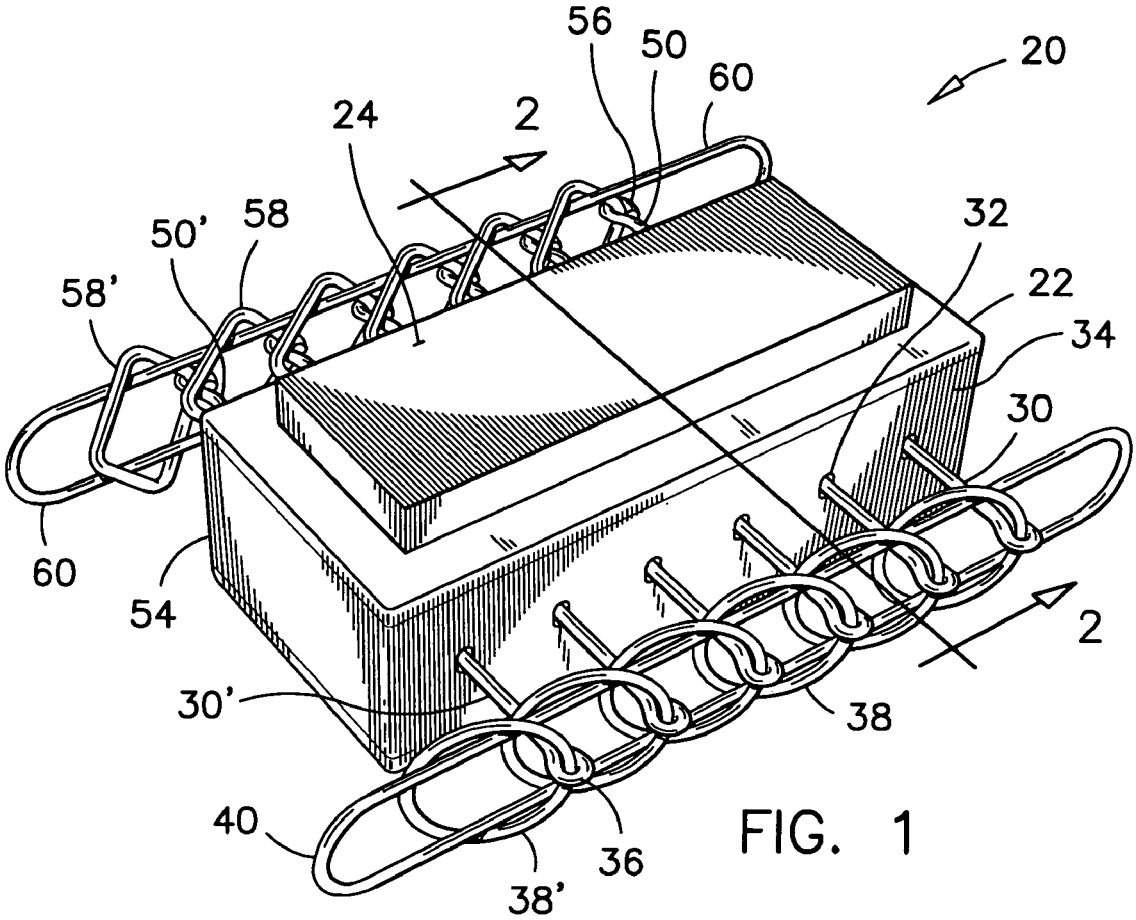
FIG. 1 is a perspective side, top and end view of the ring puzzle according to the first preferred embodiment of the present invention.

While this invention is susceptible of embodiments in many different forms, there are shown in the drawings and will be described in details herein two specific embodiments, with the understanding that the present disclosure is to be considered as an example of the principles of the invention and is not intended to limit the invention to the embodiments illustrated and described.

Figure 2:
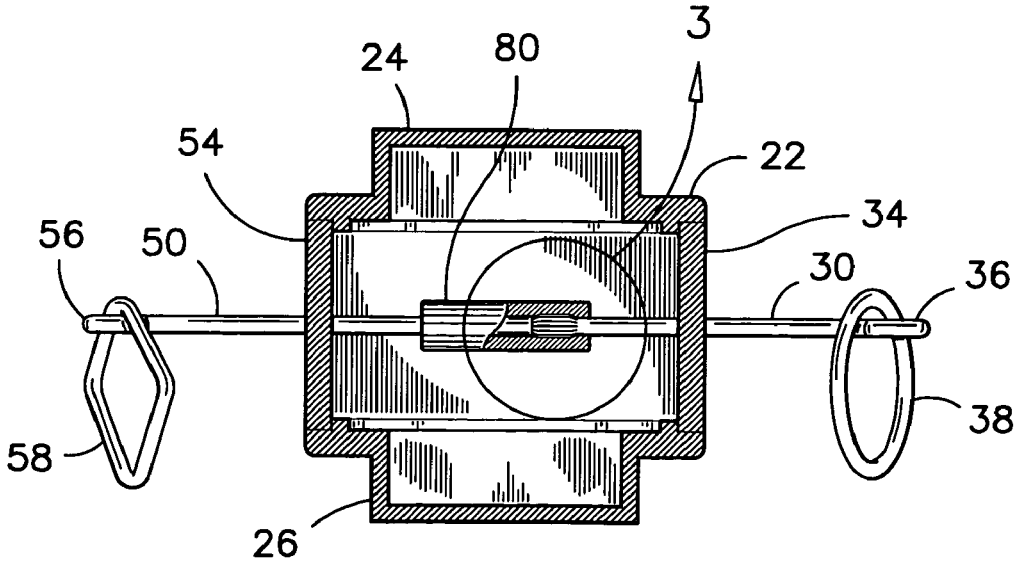
FIG. 2 is a cross-section view through the ring puzzle of FIG. 1, as seen along line 2—2 in FIG. 1.

Referring firstly to FIGS. 1 and 2, the ring puzzle 20 according to the first preferred embodiment has a hollow rectangular boxlike housing 22. The housing has a first planar projection 24 on its top surface and a second planar projection 26 on its bottom surface. Either one of the planar projections 24 and 26 can be used as a base to support the housing 22 on a table for example.

The preferred puzzle 20 has a first series of stems 30 extending through holes 32 in a first side 34 of the housing 22. The first stem in the first series of stems is labelled as 30'. Each of the stems 30, 30' has an eyelet 36 on its extremity, and a ring 38 is mounted in that eyelet. Each ring 38 except the first one 38' encloses an adjacent stem 30, 30' between the eyelet 36 on that respective adjacent stem 30 or 30' and the housing 22. A first elongated wire band 40 is mounted through all the rings 38, 38' and encloses all the stems 30, 30'.

The stems 30, 30', the rings 38, 38', and the first wire band 40 on the first side 34 of the housing 22 constitute the first game of the preferred puzzle 20. A game played with the first rings 38, 38' and the first wire band 40 represents a first degree of difficulty.

The first game is played by removing the wire band 40 from all the rings 38, 38', and from around all the stems 30, 30' starting from the first ring 38', and then reintroducing the wire band 40 back into the rings and around the stems as it was before starting the game.

The instructions to play this game and the steps required to remove and to install the wire band 40 from and into the rings 38, 38' and around the stems 30, 30' are not described herein because these instructions and procedures are well known in the art and do not constitute the focus of the present invention. A complete list of steps to play this game is disclosed in the U.S. Pat. No. 4,907,805 for example.

In the puzzle 20 according to the preferred embodiment, a second series of stems 50 extend through holes (not shown) in the second side 54 of the housing 22. The leading stem in the second series of stems is labelled as 50', and extends as a continuation of the first stem 30' in the first series of stems. Each of the stems 50, 50' has an eyelet 56 of its end and a ring or a wire loop such as diamond-shaped wire loop 58 mounted in that eyelet 56. Each wire loop 58, except the first one 58', encloses an adjacent stem 50, 50' between the eyelet 56 on that respective adjacent stem 50, 50' and the housing 22. A second elongated wire band 60 is mounted through all the wire loops 58, 58' and encloses all the stems 50, 50'.

The leading stem 50' and the first stem 30' are also designated to these unique foremost positions in the puzzle 20, because these stems are at one end of their respective series of stems and are enclosed by an adjacent ring 38 or an adjacent diamond-shaped wire loop 58 as shown in FIG. 1. Conversely, the last stem in each series of stems is not enclosed by an adjacent ring or diamond-shaped wire loop.

The stems 50,50', the diamond-shaped wire loops 58, 58', and the second wire band 60 on the second side 54 of the housing 22 constitute the second game of the preferred puzzle 20. A game played with the diamond-shaped wire loops 58, 58' and the second wire band 60 represents a second degree of difficulty, whereby the diamond-shaped wire loops 58, 58' require different manipulations than the circular rings 38, 38' of the first game.

A third degree of difficulty in this second game comes from the fact that both sides are played in a same direction. Therefore, when the housing 22 is rotated end-to-end between games, the first game is played by handling the first wire band 40 with the right hand, and the second game is played by handling the second wire band 60 with the left hand of the same player.

It will be appreciated that the diamond-shaped wire loops 58, 58' can be replaced by circular rings 38, 38', wherein the higher level of difficulty in the second game consists only in playing one of the sides with the awkward hand.

Figure 4:
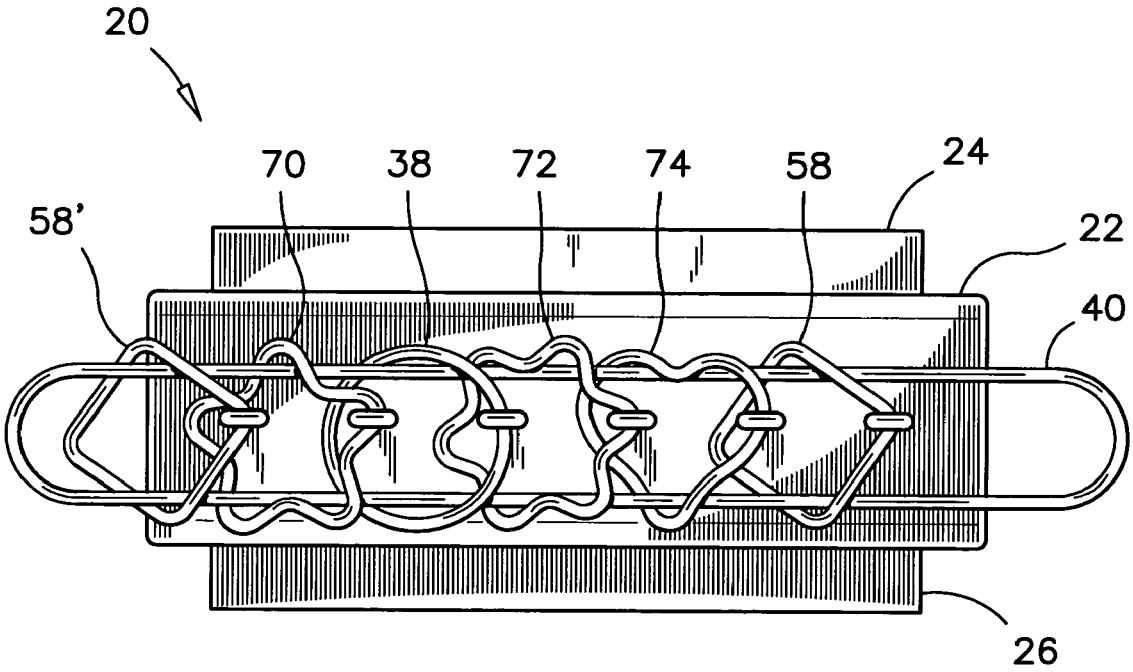
FIG. 4 is a side view of the ring puzzle according to the first preferred embodiment, showing various loop shapes to make different game variants.

Additional degrees of difficulty can be added to either sides by replacing the rings 38, 38', or the diamond-shaped wire loops 58, 58' by wire loops of different shapes such as a star shape 70, a flower-like shape 72, a heart shape 74 or any combinations of these figures or other figures, such as shown in FIG. 4. The rings 38, 38' and any other wire loops 58, 70, 72, and 74 can also be coloured of various colours such that the instructions to play the game can be given with reference to a specific ring or wire loop by colour rather than by position number.

Figure 3:
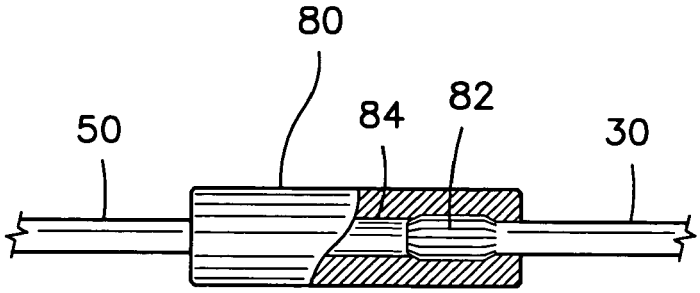
FIG. 3 is an enlarged partial cross-section view of the coupling joining opposite stems together, as seen in detail circle 3, in FIG. 2.

Referring back to FIGS. 2 and 3, the stems 30 in the first series of stems are respectively connected to the stems 50 in the second series of stems, with the first stem 30' being connected to the leading stem 50' and so forth. Opposite stems in the first and second series of stems are connected to each other by means of a sleeve-type coupling 80 enclosing the ends of the opposite stems 30, 50 or 30', 50'. Preferably, the end of each stem 30, 30' and 50, 50' has a knurled segment 82 thereon and the coupling 80 has a central hole 84 therein. The central hole 84 has a diameter which represents a tight fit over the knurled segment 82, so as to firmly retain opposite stems 30, 50 and 30', 50' together.

Both series of stems 30, 30' and 50, 50'; the rings 38, 38'; the diamond-shaped wire loops 58, 58'; the first and second wire bands 40 and 60 and the couplings 80 constitute the third game of the preferred puzzle 20.

The third game can be played by one player playing both sides of the puzzle at the same time. The third game is also played by two players, wherein the first player manipulates the first wire band 40 with his/her right hand, and the other player manipulates the second wire band 60 with his/her left hand.

It will be appreciated that a rotation of the housing 22 end-to-end reverses the hand with which the game is played by each player. It will also be appreciated that the turning of the housing 22 end-to-end, and the tilting of the housing top-to-bottom with the first planar projection 24 being used as a base, also reverse the hand with which the game is played and reverse the degree of difficulty attributed to the diamond-shaped wire loops 58. It is therefore possible to play the third game with the housing 22 set in four different orientations, wherein the game is different each time.

When the game is played by two players, one player must take advantage of the moves of the other player to solve his/her side of the puzzle. One player can also take advantage of the degree of difficulty associated with his opponent's side of the puzzle to solve his/her side ahead of his/her opponent.

The housing 22 and the couplings 80 are preferably made of molded plastic. The stems 30, 30', 50, 50'; the rings 38, 38'; the wire loops 58, 58', 70, 72, 74 and the wire bands 40, 60 are preferably made of metal wire, but can also be made of molded plastic or other material, according to the preferences of the manufacturer.

Figure 5:
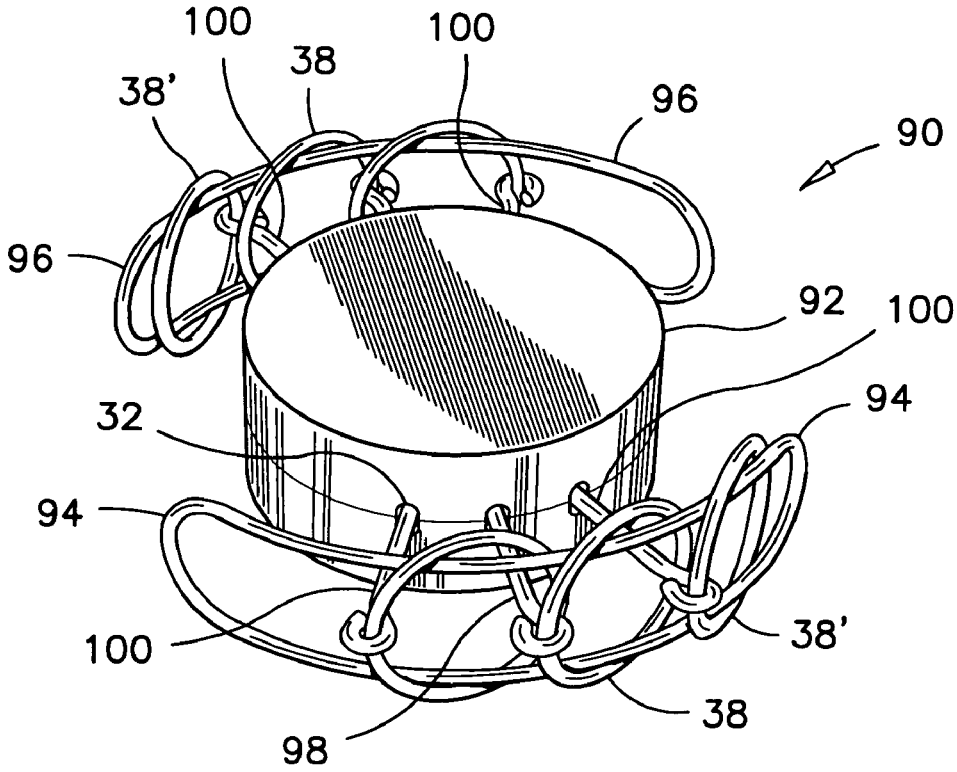
FIG. 5 illustrates a second preferred embodiment of the present invention wherein the housing thereof has a cylindrical configuration, and the stems thereof are mounted diametrically through the housing.
Figure 6:
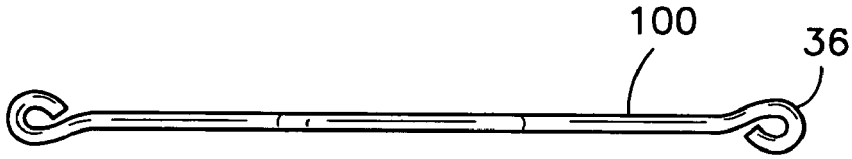
FIG. 6 is a top view of one of the double-ended stems used in the wire puzzle according to the second preferred embodiment.
Figure 7:
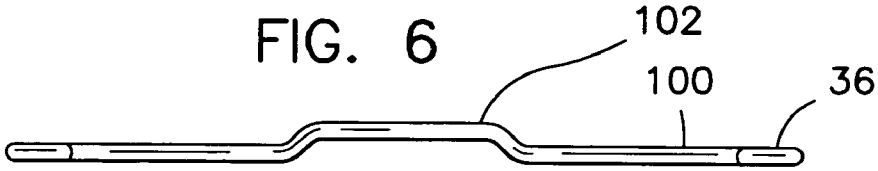
FIG. 7 is a side view of one of the double-ended stems used in the wire puzzle according to the second preferred embodiment.

Referring now to FIG. 5, there is shown therein a wire puzzle 90 according to the second preferred embodiment of the present invention. In this second preferred embodiment, the housing 92 thereof has a cylindrical shape, and both wire bands 94, 96 in the first and second games have a curved shape. In this second preferred embodiment, both sides of the puzzle 90 are played in a same direction. The stems on both sides of the housing are continuous with each other and extend diametrically through the housing 92. The central stem 98 is straight, while each of the outside stems 100, has a deviation 102 in its central segment to extend over or under the central stem 98, as shown in FIGS. 6, and 7.

A game using the puzzle 90 is played while holding the cylindrical housing 92 in one's hand and working one of the wire bands 94, 96 at a time, or both wire bands simultaneously with the other hand.

Having described a rectangular and cylindrical housings, it will be appreciated that the puzzle according to the present invention can also be made with a housing having another shape, such as an elliptical shape or a spherical shape for example. Therefore, the shape of the housing is not limited to those illustrated by labels 22 and 92.

Figure 8:
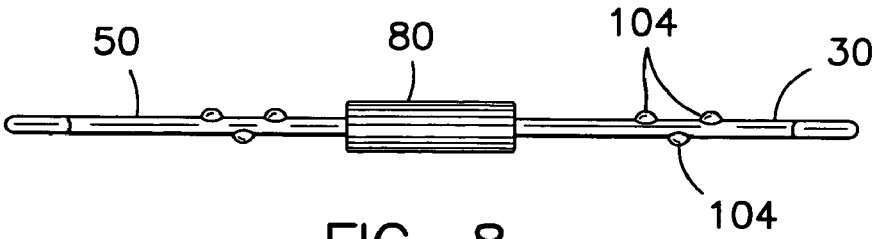
FIG. 8 is a side view of a stem with bulges thereon to provide an additional level of difficulty in playing the game with either embodiment of the present invention.

An additional level of difficulty can be added to the game played with the first or second preferred puzzle by providing at least some of the stems with staggered bulges 104, as illustrated in FIG. 8, to command the working of these stems into the corresponding holes 32 in the sides of the housing 22 or 92, such as the working of a key into a keyhole. For this purpose, the holes 32 in the sides of the housings 22 and 92 are slots as illustrated in FIGS. 1 and 5. In addition, some of the stems may be made of round or square stock to limit their rotation into their respective slots 32.

As to other manner of usage and operation of the present invention, the same should be apparent from the above description and accompanying drawings, and accordingly further discussion relative to the manner of usage and operation of the invention would be considered repetitious and is not provided.

While two embodiments of the present invention have been illustrated and described herein above, it will be appreciated by those who are skilled in the art that various modifications, alternate constructions and equivalents may be employed without departing from the true spirit and scope of the invention. Therefore, the above description and the illustrations should not be construed as limiting the scope of the invention which is defined by the appended claims.

We claim:

1. A three-way ring puzzle, comprising;

a hollow housing having a first and second opposite sides and a first and second series of holes in said first and second sides respectively;

a first series of stems extending outside said housing through said first series of holes in said first side of said housing;

a second series of stems extending outside said housing through said second series of holes in said second side of said housing;

each of said stems having an eyelet on an extremity thereof outside said housing and a wire loop loosely mounted in said eyelet;

each of said stems in said first series of stems aligning with and being joined inside said housing to one of said stems in said second series of stems, and a first and second elongated wire bands respectively mounted in said wire loops on said first and second series of stems.

2. A three-way ring puzzle as claimed in claim 1, wherein said wire loops on said stems in said first series of stems are circular rings.

3. A three-way ring puzzle as claimed in claim 1, wherein said wire loops on said stems in said second series of stems have diamond-like shapes.

4. A three-way ring puzzle as claimed in claim 1, wherein some of said wire loops have different colours.

5. A three-way ring puzzle as claimed in claim 1, wherein said holes in said first and second series of holes are slots and at least some of said stems have staggered bulges thereon for restricting a movement thereof through said slots.

6. A three-way ring puzzle as claimed in claim 1, further comprising a first planar projection on a top surface of said housing and a second planar projection on a bottom surface of said housing.

7. A three-way ring puzzle as claimed in claim 1, wherein said first series of stem comprises a first stem on one end thereof, and said second series of stems comprises a leading stem on one end thereof, and said first stem in said first series of stems being aligned with and joined to said leading stem in said second series of stems.

8. A three-way ring puzzle as claimed in claim 1, wherein each of said stems in said first series of stems being joined to one of said stems in said second series of stems by means of a sleeve-type coupling.

9. A three-way ring puzzle as claimed in claim 1, wherein said housing has a cylindrical shape and said stems extend diametrically through said housing.

10. A three-way ring puzzle as claimed in claim 7 wherein one of said wire loops on said first series of stems encloses said first stem and one of said wire loops on said second series of stems encloses said leading stem.

11. A three-way ring puzzle as claimed in claim 8, wherein each of said stems has a knurled segment on an end thereof, and said knurled segment is firmly engaged in said coupling.

12. A three-way ring puzzle, comprising;

a hollow housing having a first and second opposite sides and a first and second series of holes in said first and second sides respectively;

a first series of stems extending outside said housing through said first series of holes in said first side of said housing; said first series of stems comprising a first stem on and end thereof;

a second series of stems extending outside said housing through said second series of holes in said second side of said housing; said second series of stems comprising a leading stem on an end thereof;

each of said stems in said first series of stems aligning with and being joined to a respective one of said stems in said second series of stems, with said first stem in said first series of stems aligning with and being joined to said leading stem in said second series of stems;

each of said stems having an eyelet on an extremity thereof outside said housing;

a first series of wire loops mounted in said eyelets on said stems in said first series of stems, with one of said wire loops in said first series of wire loops being loosely mounted in a respective one of said eyelets on said stems in said first series of stems;

a second series of wire loops mounted in said eyelets on said stems in said second series of stems, with one of said wire loops in said second series of wire loops being loosely mounted in a respective one of said eyelets on said stems in said second series of stems;

a first elongated wire band mounted in said wire loops in said first series of wire loops and enclosing said stems in said first series of stems;

a second elongated wire band mounted in said wire loops in said second series of wire loops and enclosing said stems in said second series of stems, and said first stem in said first series of stems being enclosed by one of said wire loops in said first series of wire loops, and said leading stem in said second series of stems being enclosed by one of said wire loops in said second series of wire loops.

13. A three-way ring puzzle as claimed in claim 12, wherein said wire loops in said first series of wire loops are circular rings, and said wire loops in said second series of wire loops have diamond-like shapes.

14. A three-way ring puzzle as claimed in claim 12, wherein each of said stems in said first series of stems are joined to one of said stems in said second series of stems by means of a sleeve-type coupling, and each of said stems has a knurled segment on an end thereof, and said knurled segment is firmly engaged in said coupling.

15. A three-way ring puzzle, comprising;

a hollow cylindrical housing;

a series of stems extending diametrically through said housing;

each stem having a first and second extremities outside said housing and an eyelet on each of said extremities;

a first series of wire loops mounted in said eyelets on said first extremities, with one of said wire loops in said first series of wire loops being loosely mounted in a respective one of said eyelets on said first extremities;

a second series of wire loops mounted in said eyelets on said second extremities, with one of said wire loops in said second series of wire loops being loosely mounted in a respective one of said eyelets on said second extremities;

a first curved wire band mounted through said wire loops in said first series of wire loops and enclosing said stems near said first extremities of said stems, and a second curved wire band mounted through said wire loops in said second series of wire loops and enclosing said stems near said second extremities of said stems.

16. A three-way puzzle as claimed in claim 15, wherein said series of stems comprises three stems.

17. A three-way puzzle as claimed in claim 15 wherein said wire loops are circular rings.

18. A three-way puzzle as claimed in claim 15, wherein said cylindrical housing has a cylindrical surface having slots therein and said stems extend through said slots; and at least some of said stems have staggered bulges thereon for restricting a movement thereof through said slots.

19. A three-way puzzle as claimed in claim 15, wherein said wire loops have different colours.

20. A three-way puzzle as claimed in claim 16, wherein said three stems comprises a central stem and two outside stems, and said central stem is straight and each of said outside stems has a deviation in a central segment thereof.

* * * * *